US008385766B2

(12) United States Patent
Inukai

(10) Patent No.: US 8,385,766 B2
(45) Date of Patent: Feb. 26, 2013

(54) IMAGE FORMING APPARATUS AND HIGH VOLTAGE GENERATING POWER SUPPLY INCLUDING A POWER SUPPLY DISCONNECT

(75) Inventor: Katsumi Inukai, Iwakura (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 441 days.

(21) Appl. No.: 12/727,557

(22) Filed: Mar. 19, 2010

(65) Prior Publication Data

US 2010/0272463 A1 Oct. 28, 2010

(30) Foreign Application Priority Data

Apr. 28, 2009 (JP) ..... 2009-109581

(51) Int. Cl.
*G03G 15/00* (2006.01)

(52) U.S. Cl. ..... 399/88

(58) Field of Classification Search ..... 399/9, 88–90
See application file for complete search history.

(56) References Cited

U.S. PATENT DOCUMENTS 7,460,808 B2 * 12/2008 Okada ..... 399/88
2008/0298091 A1 12/2008 Inukai

FOREIGN PATENT DOCUMENTS

JP 7-244452 A 9/1995
JP A-2003-47239 2/2003
JP 2004-109166 A 4/2004
JP 2004-148724 A 5/2004
JP A-2004-176732 6/2004
JP A-2004-219832 8/2004
JP A-2006-159740 6/2006
JP A-2008-299203 12/2008

OTHER PUBLICATIONS

Notification of Reason for Refusal dated Jan. 17, 2012 received from the Japanese Patent Office from related Japanese Application No. 2009-109581, together with an English-language translation.
Official Action dated May 10, 2011 received from the Japanese Patent Office, together with an English-language translation from related Japanese Application No. 2009-109581.

* cited by examiner

*Primary Examiner* — William J Royer
(74) *Attorney, Agent, or Firm* — Scully, Scott, Murphy & Presser, P.C.

(57) ABSTRACT

An image forming apparatus includes, an image forming unit, an irradiating unit, a first low voltage power supply which generates a first low voltage, a first low voltage power supply line, a first switching element, a first high voltage generating unit including a first transformer, a second low voltage power supply, and a control unit. The image forming apparatus further includes a cover which can be opened and closed, wherein the image forming unit detects the opening and closing of the cover; and an interlock switch which interlocks with the opening/closing of the cover and includes a first contact point connected to the first low voltage power supply and a second contact point connected to the first low voltage power supply line, wherein the interlock switch is opened to disconnect the first contact point from the second contact point when the cover is opened.

11 Claims, 2 Drawing Sheets

IMAGE FORMING APPARATUS AND HIGH VOLTAGE GENERATING POWER SUPPLY INCLUDING A POWER SUPPLY DISCONNECT

CROSS-REFERENCE TO RELATED APPLICATIONS

The present application claims priority from Japanese Patent Application No. 2009-109581, which was filed on Apr. 28, 2009, the disclosure of which is herein incorporated by reference in its entirety.

TECHNICAL FIELD

The present invention relates to an image forming apparatus and a high voltage generating power supply, and more particularly, to a technique for cutting off power supplied to a load in connection with a cover opening of an image forming apparatus.

BACKGROUND

As one example of such kinds of techniques, a technique in which a connection end of a laser diode (LD) to a 5V power supply line is directly connected to an input port of a CPU for cover open detection is conventionally known. In this technique, an interlock switch is provided for each of the 5V power supply line and a 24V power supply line which supplies power to a motor and, when a cover is opened, power to the LD and the motor is cut off and the cover opening is detected by software.

An image forming apparatus generally includes a plurality of high voltage generators (high voltage loads) which generates different voltages and is supplied with power with different voltages depending on a level of voltage to be generated. Due to a demand for safety and power saving, there is a need for a technique which is capable of cutting off power from a plurality of high voltage loads in interlock with the cover opening. Consideration has been made of a method which switches the power supply ON/OFF using, for example, a switching element for the cutting-off of power from the high voltage loads in interlock with the cover opening. In this case, a method of PWM-controlling the switching element in order to reduce an inrush current which may be generated when the power supply is switched ON may be contemplated. However, this may require a complicated control circuit.

An exemplary embodiment of the present invention may make it possible to provide a technique which is suitable to cut off power from an LD and a high voltage load with a simple configuration. It is another object of the present invention to provide a technique which is suitable to cut off power from a plurality of high voltage generating units with different voltages generated, which are included in a high voltage generating power supply, with a simple configuration.

SUMMARY

An image forming apparatus according to an exemplary embodiment of the present invention comprises: an image forming unit which includes a photoconductor and forms an image on a recording medium, an irradiating unit which irradiates the photoconductor with laser light; a first low voltage power supply which generates a first low voltage, a first low voltage power supply line which is connected to the irradiating unit and the first low voltage power supply and supplies the first low voltage from the first low voltage power supply to the irradiating unit, a first switching element which has a control terminal electrically connected to the first low voltage power supply line and generates a first oscillating current, a first high voltage generating unit which is connected to the first switching element and an electrical load of the image forming unit, wherein the first high voltage generating unit supplies a first high voltage to the electrical load of the image forming unit, a first transformer which is included in the first high voltage generating unit and generates the first high voltage by boosting a second low voltage higher than the first low voltage based on the first oscillating current; a second low voltage power supply which is connected to the first transformer and supplies the second low voltage to the first transformer, a control unit which includes an input/output port electrically connected to the first low voltage power supply line and controls the first switching element, a cover which can be opened and closed, wherein the image forming unit detects the opening and closing of the cover, and an interlock switch which interlocks with the opening/closing of the cover and includes a first contact point connected to the first low voltage power supply and a second contact point connected to the first low voltage power supply line, wherein the interlock switch is opened to disconnect the first contact point from the second contact point when the cover is opened.

A high voltage generating power supply according to an exemplary embodiment of the present invention comprises: a first low voltage terminal which receives a first low voltage from a first low voltage power supply, a first low voltage power supply line which is connected to the first low voltage terminal, a second low voltage terminal which receives a second low voltage higher than the first low voltage from a second low voltage power supply, a second low voltage power supply line which is connected to the second low voltage terminal, a first switching element which has a control terminal electrically connected to the first low voltage power supply line and generates a first oscillating current, a first high voltage generating unit which generates a first high voltage and includes a first transformer which generates the first high voltage by boosting the second low voltage based on the first oscillating current, a second switching element which has a control terminal electrically connected to the second low voltage power supply line and generates a second oscillating current, a second high voltage generating unit which generates a second high voltage higher than the first high voltage and includes a second transformer which generates the second high voltage by boosting the second low voltage based on the second oscillating current, a control unit which includes an input/output port electrically connected to the first low voltage power supply line and controls the first switching element and the second switching element, and a low voltage power supply cutting-off unit which is electrically connected to the input/output port and the second low voltage power supply line and electrically disconnects the second low voltage power supply line from the control terminal of the second switching element when supply of the first low voltage is cut off.

DESCRIPTION

Hereinafter, a first embodiment of the present invention will be described with reference to FIGS. 1 and 2.

1. Configuration of Image Forming Apparatus

Figure 1:
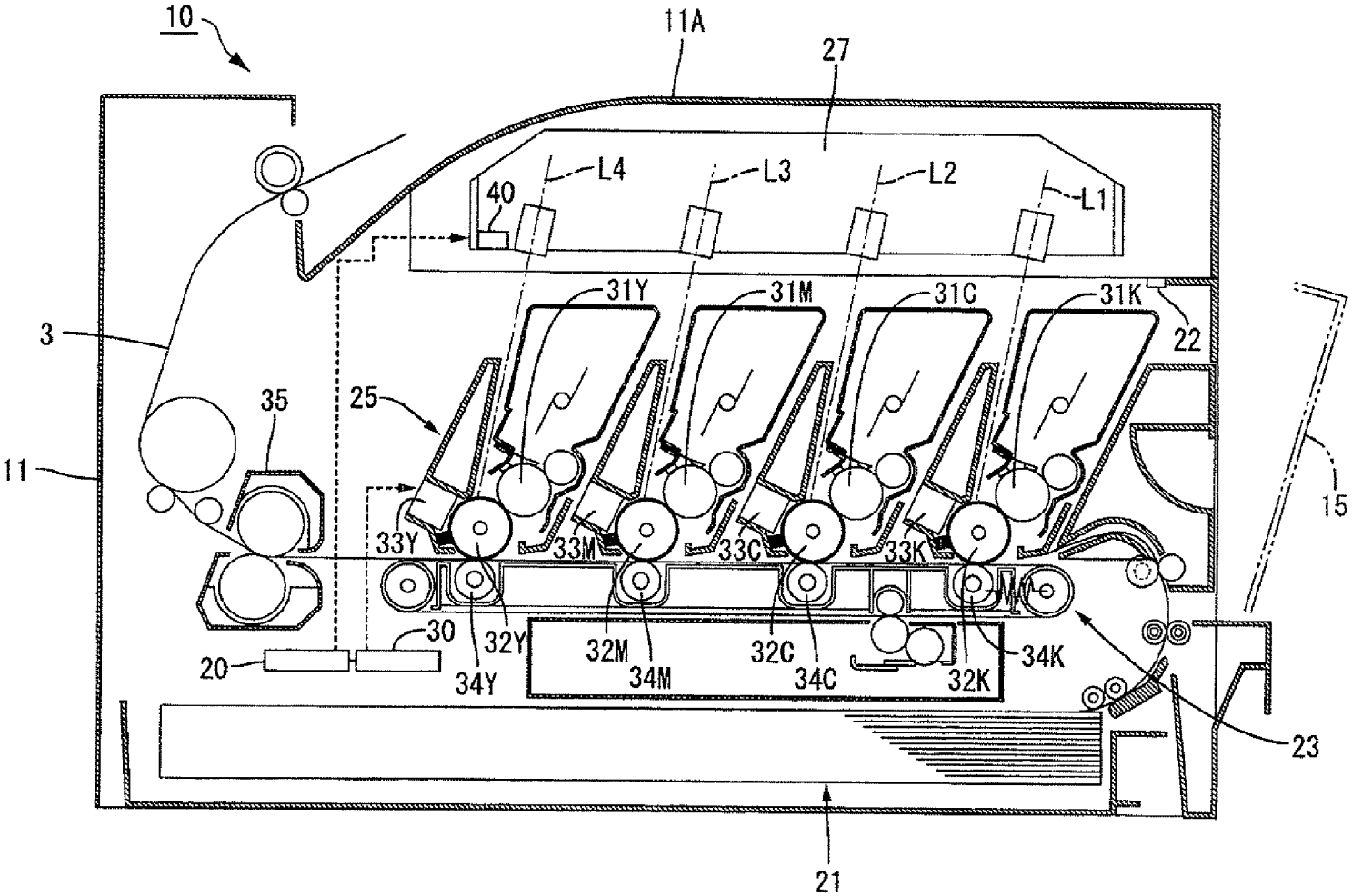
FIG. 1 is a side sectional view schematically showing an internal configuration of a laser printer according to an embodiment of the present invention.
Figure 2:
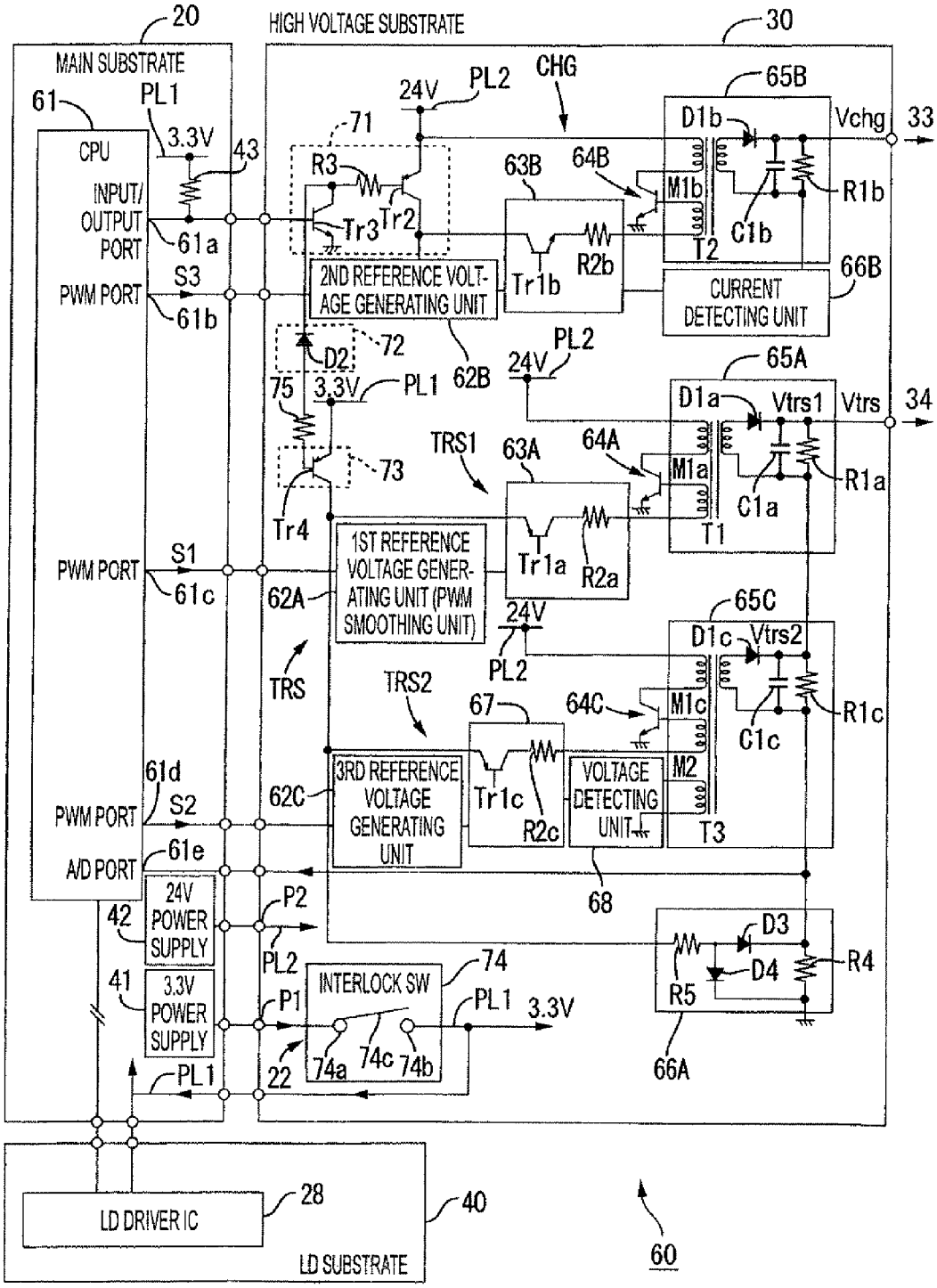
FIG. 2 is a schematic block diagram of a circuit related to generation of high voltages according to an embodiment of the present invention.

FIG. 1 is a main part side sectional view schematically showing an internal configuration of an image fowling apparatus according to one embodiment of the present invention. In this figure, the image forming apparatus is illustrated with a laser printer 10.

The shown laser printer 10 is a so-called direct tandem type color laser printer including four developing rollers 31K, 31C, 31M and 31Y corresponding respectively to colors of black (K), cyan (C), magenta (M) and yellow (Y), and photoconductive drums (examples of photoconductors) 32K, 32C, 32M and 32Y. In the following description, a front side refers to the right side of FIG. 1. The image forming apparatus is not limited to the color laser printer but may, for example, be a monochrome laser printer, an LED printer or a so-called multifunction printer having a facsimile function and a copying function.

The laser printer 10 (hereinafter abbreviated as "printer") includes a box-like body casing 11. Within the body casing 11 are stacked a sheet feeding unit 21, a sheet carrying unit 23 which carries a sheet (an example of recording medium) 3, an image forming unit 25 which forms an image according to an electro-photographic method, and a scanner unit (an example of "light irradiating unit") 27 in order from the bottom.

The image forming unit 25 includes the developing rollers 31 (31K to 31Y), the photoconductive drums 32 (32K to 32Y), chargers (corresponding to "charging units": an example of "electrical load") 33 (33K to 33Y), transfer rollers (corresponding to "transferring units": an example of "electrical load") 34 (34K to 34Y), and a fixing unit 35. The fixing unit 35 thermally fixes a toner image transferred onto the sheet 3.

The front side of the body casing 11 is an access port for access to the image forming unit 25 in which a front cover (an example of an "opening/closing cover") 15 is rotatably provided. This allows the access port to be closed or opened. In addition, an opening/closing sensor 22 is arranged adjacent to the front cover 15. The opening/closing sensor 22 generates a detection signal according to the opening/closing of the front cover 15 and supplies the detection signal to a high voltage substrate 30.

The scanner unit 27 contains a polygon mirror (not shown), four laser diodes (not shown) corresponding to respective colors, and an LD substrate 40 which drives the laser diodes. The LD substrate 40 includes an LD driver IC which drives the laser diodes. Laser lights L1 to L4 emitted from the respective laser diodes are deflected by the polygon mirror, redirected by optical parts such as a reflection mirror disposed on an optical path, and then are irradiated on surfaces of the photoconductive drums 32 (32K to 32Y) at a high speed scan, as shown in FIG. 1. Accordingly, electrostatic latent images are formed on the photoconductive drums 32 (32K to 32Y).

Thereafter, an image is formed on the sheet 3 carried via a sheet carrying path (not shown) through a developing process, a transferring process and a fixing process, and the sheet 3 with the image formed thereon is discharged onto a discharge tray provided on a top wall 11A of the body easing 11.

In addition, within the body casing 11 is provided a main substrate 20 which supplies power to the high voltage substrate 30 and the LD substrate 40 and controls these substrates.

2. Configuration of High Voltage Generating Power Supply

Next, a configuration of one embodiment of the high voltage generating power supply according to the present invention will be described with reference to a circuit block diagram of FIG. 2. FIG. 2 shows a schematic circuit configuration of the main substrate 20, the high voltage substrate 30 and the LD substrate 40. The high voltage generating power supply 60 generally includes a circuit configuration provided in the main substrate 20 and the high voltage substrate 30. This embodiment shows a case where the high voltage generating power supply 60 is provided in the printer 10. In addition, the high voltage generating power supply 60 is not limited to the case where it is provided in the printer 10, but may be provided in other apparatuses using different high voltages. In addition, although circuits corresponding to different colors are provided in the high voltage substrate 30, since these circuits have substantially the same configuration, only a configuration corresponding to a single color is shown in FIG. 2.

The main substrate 20 includes a CPU (an example of "control unit") 61, a 3.3V power supply (an example of "first low voltage power supply") 41, a 24V power supply (an example of "second low voltage power supply") 42, and a pull-up resistor 43. The 3.3V power supply 41 generates a 3.3V low voltage (an example of "first low voltage"). The 24V power supply 42 generates a 24V low voltage (an example of "second low voltage").

The high voltage substrate 30 generally includes a transfer voltage generating unit TRS which generates a transfer voltage (an example of "first high voltage") Vtrs applied to the transfer rollers 34, a transfer voltage generating unit CHG which generates a charge voltage (an example of "second high voltage") Vchg applied to the chargers 33, and an interlock switch 74. Here, the transfer voltage Vtrs is about −500V to −7 kV and the charge voltage Vchg is about 5 kV to 8 kV. Typically, the charge voltage Vchg is larger than the transfer voltage Vtrs (in terms of an absolute value).

In this embodiment, the transfer voltage generating unit TRS includes a forward transfer voltage generating unit TRS1 which generates a forward transfer voltage Vtrs1 which is a negative high voltage, and a backward transfer voltage generating unit TRS2 which generates a backward transfer voltage Vtrs2 which is a positive high voltage. The backward transfer voltage Vtrs2 is applied to the transfer rollers 34 in order to return toner attached to the transfer rollers 34 to the photoconductive drums 32 for cleaning the transfer rollers 34. In addition, the backward transfer voltage Vtrs2 may be also used to suppress an effect by a current introduced from the photoconductive drums 32 into the transfer rollers 34.

The forward transfer voltage generating unit TRS1 includes a first reference voltage generating unit (PWM smoothing unit) 62A, a first constant current control unit 63A, an NPN transistor (an example of "first switching element") 64A, a first boosting/rectifying unit (an example of "first high voltage generating unit") 65A, and a current detecting unit 66A.

The first reference voltage generating unit (PWM smoothing unit) 62A smoothes a PWM (Pulse Width Modulation) signal S1 from a PWM port 61*c* of the CPU 61 and provides the smoothed PWM signal S1 to the first constant current control unit 63A. The first constant current control unit 63A includes, for example, a PNP transistor Tr1*a* and a resistor R2*a*. The CPU 61 generates the PWM signal S1 such that a transfer current reaches a predetermined value based on a detection value of the current detecting unit 66A. The first constant current control unit 63A controls the PNP transistor Tr1*a* based on the PWM signal S1.

The first boosting/rectifying unit 65A includes, for example, a transformer (an example of "first transformer") T1, a diode D1*a*, a smoothing capacitor C1*a* and a resistor R1*a*, which are provided at a secondary side of the transformer T1. The transformer T1 has an auxiliary winding (corresponding to "auxiliary winding" in the present invention) M1*a* at its primary side. One end of the auxiliary winding M1*a* of the transformer T1 is connected to the resistor R2*a* of the first constant current control unit 63A, while the other end of the auxiliary winding M1*a* is connected to a base (an example of a "control terminal") of the NPN transistor 64A. An emitter of the NPN transistor 64A is connected to a ground and a collector of the NPN transistor 64A is connected to one end of a primary winding of the transformer T1. The other end of the primary winding is connected to a 24V power supply line (an example of "second low voltage power supply line") PL2. The NPN transistor 64A generates an oscillating current (first oscillating current) under the control of the first constant current control unit 63A and the transformer T1 generates the forward transfer voltage Vtrs1 by boosting 24V based on the oscillating current.

The current detecting unit 66A includes, for example, diodes D3 and D4 and resistors R4 and R5. One end of the resistor R4 is connected to an A/D port 61*e* of the CPU 61. The current detecting unit 66A supplies a detection signal to the A/D port 61*e* of the CPU 61.

The backward transfer voltage generating unit TRS2 includes a third reference voltage generating unit 62C, a constant voltage control unit 67, an NPN transistor (an example of "first switching element") 64C, a voltage detecting unit 68, and a third boosting/rectifying unit (an example of "first high voltage generating unit") 65C.

The third reference voltage generating unit (PWM smoothing unit) 62C smoothes a PWM signal S2 from a PWM port 61*d* of the CPU 61 and provides the smoothed PWM signal S2, as a reference voltage, to the constant voltage control unit 67. The constant voltage control unit 67 includes, for example, a PNP transistor Tr1*c* and a resistor R2*c*. The constant voltage control unit 67 controls the PNP transistor Tr1*c* based on the reference voltage and a detection value of the voltage detecting unit 68 such that the backward transfer voltage Vtrs2 reaches a predetermined value.

The third boosting/rectifying unit 65C includes, for example, a transformer (an example of "first transformer") T3, a diode D1*c*, a smoothing capacitor C1*c* and a resistor R1*c*, which are provided at a secondary side of the transformer T3. The transformer T3 has a first auxiliary winding (corresponding to "auxiliary winding" in the present invention) M1*c* and a second auxiliary winding M2 at its primary side. One end of the first auxiliary winding M1*c* is connected to the resistor R2*c* of the constant voltage control unit 67, while the other end of the first auxiliary winding M1*c* is connected to a base (an example of a "control terminal") of the NPN transistor 64C. An emitter of the NPN transistor 64C is connected to a ground and its collector is connected to one end of a primary winding of the transformer T3. The other end of the primary winding is connected to the 24V power supply line PL2. One end of the second auxiliary winding M2 is connected to the voltage detecting unit 68, while its other end is connected to the ground. The NPN transistor 64C generates an oscillating current (first oscillating current) under control of the constant voltage control unit 67 and the transformer T3 generates the backward transfer voltage Vtrs2 by boosting 24V based on the oscillating current.

The transfer voltage generating unit CHG includes a second reference voltage generating unit (PWM smoothing unit) 62B, a second constant current control unit 63B, an NPN transistor (an example of "second switching element") 64B, a second boosting/rectifying unit (an example of "second high voltage generating unit") 65B, and a current detecting unit 66B.

The second reference voltage generating unit (PWM smoothing unit) 62B smoothes a PWM signal S3 from a PWM port 61*b* of the CPU 61 and provides the smoothed PWM signal S3, as a reference voltage, to the second constant current control unit 63B. The second constant current control unit 6313 includes, for example, a PNP transistor Tr1*b* and a resistor R2*b*. The second constant current control unit 6313 controls the PNP transistor Tr1*b* based on the reference voltage and a detection value of the voltage detecting unit 66B such that the charge current (discharge current) reaches a predetermined value.

The second boosting/rectifying unit 65B includes, for example, a transformer (an example of "second transformer") T2, a diode D1*b*, a smoothing capacitor C1*b* and a resistor Rib, which are provided at a secondary side of the transformer T2. The transformer T2 has an auxiliary winding M1*b* at its primary side. One end of the auxiliary winding M1*b* of the transformer T2 is connected to the resistor R2*b* of the second constant current control unit 6313, while the other end of the auxiliary winding M1*b* is connected to a base (an example of a "control terminal") of the NPN transistor 64B. An emitter of the NPN transistor 64B is connected to a ground and a collector of the NPN transistor 64B is connected to one end of a primary winding of the transformer T2. The other end of the primary winding is connected to the 24V power supply line PL2. The NPN transistor 64B generates an oscillating current (second oscillating current) under control of the second constant current control unit 63B and the transformer T2 generates the charge voltage Vchg by boosting 24V based on the oscillating current.

The interlock switch 74 is controlled in interlock with opening/closing of the front cover 15. The interlock switch 74 includes a first contact point 74*a* connected to a 3.3V power supply, a second contact point 74*b* connected to a 3.3V power supply line PL1 (an example of a "first low voltage power supply line"), and a switch piece 74*c* which switches ON/OFF a connection between the first contact point 74*a* and the second contact point 74*b*. When the front cover 15 is opened, the switch piece 74*c* is opened according to a detection signal of the opening/closing sensor 22. In this case, the interlock switch 74 is in an opened state where the first contact point 74*a* is disconnected from the second contact point 74*b*.

The high voltage substrate 30 includes a low voltage power supply cutting-off unit 71, a voltage application preventing unit 72 and a counter electromotive force cutting-off unit 73.

The low voltage power supply cutting-off unit 71 includes, for example, a resistor R3, a PNP transistor Tr2 and an NPN transistor Tr3. An emitter of the PNP transistor Tr2 is connected to the 24V power supply 42 via the 24V power supply line PL2 and its collector is connected to the collector of the NPN transistor 64B of the second constant current control unit 6313. A base of the PNP transistor Tr2 is connected to a collector of the NPN transistor Tr3 via the resistor R3.

An emitter of the NPN transistor Tr3 is connected to a ground, and its base is connected to an output port 61*a* of the CPU 61 while being connected to the 3.3V power supply line PL1, i.e., the second contact point 74*b* of the interlock switch 74, via the pull-up resistor 43. Accordingly, when the front cover 15 is opened, the NPN transistor Tr3 is turned off without a voltage applied to the base of the NPN transistor Tr3. At this time, since the PNP transistor Tr2 is also turned off, the 24V power supply 42 is electrically disconnected from the second constant current control unit 63B. As a result, the 24V power supply 42 is electrically disconnected from the base of the NPN transistor 64B, thereby stopping the second boosting/rectifying unit 65B.

In addition, as the NPN transistor Tr3 is turned off, a base voltage of a PNP transistor Tr4 of the counter electromotive force cutting-off unit 73, which will be described later, has a high level, thereby turning the PNP transistor Tr4 off. Accordingly, the 3.3V power supply 41 is electrically disconnected from the first constant current control unit 63A and the constant voltage control unit 67. As a result, the 3.3V power supply 41 is electrically disconnected from the bases of the NPN transistors 64A and 64C, thereby stopping the first and third boosting/rectifying unit 65A and 65C. In other words, simply by cutting-off the voltage supply of 3.3V in interlock with the opening/closing of the front cover 15, it is possible to stop generation of the transfer voltage (first high voltage) Vtrs and the charge voltage (second high voltage) Vchg.

The voltage application preventing unit 72 is connected between the low voltage power supply cutting-off unit 71 and the counter electromotive force cutting-off unit 73 and prevents a 24V voltage from being applied to the counter electromotive force cutting-off unit 73. More specifically, the voltage application preventing unit 72 includes a diode D2 having a cathode connected to the resistor R3 of the low voltage power supply cutting-off unit 71 and an anode connected to the base of the PNP transistor Tr4 via a current limit resistor 75. Accordingly, when the NPN transistor Tr3 of the low voltage power supply cutting-off unit 71 is turned off, the voltage application preventing unit 72 prevents the 24V voltage from being applied to the base of the PNP transistor Tr4 of the counter electromotive force cutting-off unit 73. In other words, the voltage application preventing unit 72 prevents the base voltage of the PNP transistor Tr4 from increasing over 3.3V by a predetermined value. In this case, the voltage application preventing unit 72 also prevents a current from being introduced from the low voltage power supply cutting-off unit 71 into the counter electromotive force cutting-off unit 73. Also, in this case, the resistor R3 of the low voltage power supply cutting-off unit 71 is involved in reduction of a voltage applied to the base of the PNP transistor Tr4. The configuration of the voltage application preventing unit 72 is not limited to that shown in FIG. 2.

The counter electromotive force cutting-off unit 73 is connected between the 3.3V power supply line PL1 and the auxiliary winding M1*a* via the first constant current control unit 63A. The counter electromotive force cutting-off unit 73 is also connected between the 3.3V power supply line PL1 and the auxiliary winding M1*c* via the constant voltage control unit 67. Here, as shown in FIG. 2, the counter electromotive force cutting-off unit 73 includes, for example, the PNP transistor Tr4. An emitter of the PNP transistor Tr4 is connected to the 3.3V power supply line PL1, and a collector of the PNP transistor Tr4 is connected to an emitter of the PNP transistor Tr1*a* of the first constant current control unit 63A and an emitter of the PNP transistor Inc of the constant voltage control unit 67.

The counter electromotive force cutting-off unit 73 switches ON/OFF supply of power from the 3.3V power supply line PL1 to the bases of the NPN transistors 64A and 64C. In addition, since the PNP transistor Tr4 is turned off when the interlock switch 74 is opened, the counter electromotive force cutting-off unit 73 electrically disconnects the auxiliary windings M1*a* and M1*c* from the 3.3V power supply line. Accordingly, when the 3.3V voltage is cut off, it is possible to avoid a problem which may be caused by a counter electromotive force generated by the auxiliary windings M1*a* and M1*c*. In particular, if a counter electromotive force of a negative voltage is applied to the LD substrate (irradiating unit) 40 via the 3.3V power supply line PL1, there is a possibility of breakage of the LD driver IC 28. Accordingly, by cutting-off the 3.3V voltage in interlock with opening of the interlock switch 74, it is possible to prevent the LD driver IC 28 from being broken.

In addition, the CPU 61 includes the input/output port 61*a*. In the condition where the interlock switch 74 is opened, that is, the 3.3V voltage is being applied to the substrates 20, 30 and 40, the CPU 61 makes the input/output port 61*a* impedance-high in driving the transformers T1 and T3 and/or the transformer T2, while making the input/output port 61*a* logically low in stopping the transformers T1 and T3 and the transformer T2. This is because, when the interlock switch 74 is closed, for example, when the printer 10 is in a sleep mode or a standby mode, if the transformers T1 and T3 and the transformer T2 are stopped, power is consumed by only the pull-up resistor 43. In other words, this is because power is consumed by only the pull-up resistor 43 when output of the PWM signals S1, S2 and S3 is stopped and the first to third boosting/rectifying units 65A, 65B and 65C are stopped in the sleep mode or standby mode of the printer 10

In addition, in a normal operation of the first to third boosting/rectifying units 65A, 65B and 65C, since the input/output port 61*a* has high impedance, it is possible to properly turn on the NPN transistor Tr3 of the low voltage power supply cutting-off unit 71 and the PNP transistor Tr4 of the counter electromotive force cutting-off unit 73 via the pull-up resistor 43.

In addition, in the condition where the interlock switch 74 is closed, when the input/output port 61*a* has a low level, the NPN transistor Tr3 of the low voltage power supply cutting-off unit 71 is turned off. In this case, as described above, the voltage application preventing unit 72 prevents the 24V voltage from being applied to the base of the PNP transistor Tr4 of the counter electromotive force cutting-off unit 73 and prevents a current from being introduced from the 24V power supply 42 into the base of the PNP transistor Tr4.

The high voltage substrate 30 further includes a first low voltage terminal P1 which receives the 3.3V voltage from the 3.3V power supply 41 and a second low voltage terminal P2 which receives the 24V voltage from the 24V power supply 42. The first low voltage terminal P1 is connected to the first contact point 74*a* of the interlock switch 74.

In addition, the high voltage generating power supply 60 of the present invention includes at least the first low voltage terminal P1, the 3.3V power supply line (first low voltage power supply line) PL1, the second low voltage terminal P2, the 24V power supply line (second low voltage power supply line) PL2, the NPN transistor (first switching element) 64A, the first boosting/rectifying unit (first high voltage generating unit) 65A, the NPN transistor (second switching element) 64B, the second boosting/rectifying unit (second high voltage generating unit) 6513, the CPU (control unit) 61 and the low voltage power supply cutting-off unit 71. The high voltage generating power supply 60 preferably includes the voltage application preventing unit 72. In addition, the high voltage generating power supply 60 may further include the NPN transistor (counter electromotive force cutting-off unit) Tr4 and/or the pull-up resistor 43.

3. Effects of Embodiment (1) According to this embodiment, one interlock switch 74 may be used to cut off supply of power from the 3.3V power supply 41 to the laser diode and the first to third boosting/rectifying units (high voltage loads) 65. In this case, only by cutting off supply of the 3.3V voltage in interlock with the opening/closing of the front cover 15, it is possible to properly stop generation of the transfer voltage (first high voltage) Vtrs and the charge voltage (second high voltage) Vchg. Accordingly, it is possible to cut off supply of power to the laser diode and the high voltage loads with a simple configuration.

(2) In addition, in this embodiment, the NPN transistor (counter electromotive force cutting-off unit) 73 is provided between the auxiliary windings M1*a* and M1*c* of the transformers T2 and T3 and the 3.3V power supply line PL1. Accordingly, when the interlock switch 74 is opened, that is, when the 3.3V voltage (first low voltage) is cut off; it is possible to avoid a problem which may be caused by a counter electromotive force generated by the auxiliary windings M1*a* and M1*c*. As a result, it is possible to prevent a counter electromotive force of a negative voltage from being applied to the LD substrate 40 via the 3.3V power supply line PL1, thereby preventing the LD driver IC 28 or the like from being broken.

(3) In addition, the voltage application preventing unit 72 is provided between the low voltage power supply cutting-off unit 71 and the NPN transistor (counter electromotive force cutting-off unit) 73. Accordingly, it is possible to prevent the first boosting/rectifying unit (first high voltage generating unit) 65A and the third boosting/rectifying unit (first high voltage generating unit) 65C from malfunctioning due to a voltage applied thereto from the 24V power supply 42 and a current introduced thereinto.

(4) Moreover, in the condition where the interlock switch 74 is closed, the CPU 61 makes the input/output port 61*a* impedance-high in driving the transformers T1 and T3 and/or the transformer T2, while making the input/output port 61*a* logically low in stopping the transformers T1 and T3 and the transformer T2. In other words, in the condition where the interlock switch 74 is closed, the CPU 61 can control the low voltage power supply cutting-off unit 71 to cut off the same low voltage power supply as in the opened condition of the interlock switch 74. Accordingly, for example, when the printer 10 is in a sleep mode or a standby mode, power related to the high voltage substrate 30 can be practically consumed by only the pull-up resistor 43. As a result, it is possible to achieve energy conservation regarding the high voltage substrate 30 and further the printer 10.

The present invention is not limited to the embodiment shown and described in the above description and the drawings. For example, the technical scope of the present invention encompasses the following embodiments and various modifications may be made without departing from the spirit and scope of the invention.

(1) Although it has been illustrated in the above-described embodiment that the 3.3V power supply 41 and the 24V power supply 42 are provided on the main substrate 20, the present invention is not limited thereto. For example, the 3.3V power supply 41 and the 24V power supply 42 may be provided on a power supply substrate (not shown). In addition, although it has been illustrated that the interlock switch 74 is provided on the high voltage substrate 30, the present invention is not limited thereto. For example, the interlock switch 74 may be provided on the power supply substrate.

(2) Although it has been illustrated in the above-described embodiment that the first and second switching elements, the transistor Tr4 and the like are constituted by bipolar transistors such as an NPN transistor and a PNP transistor, the present invention is not limited thereto. For example, the bipolar transistors may be replaced with field effect transistors (FETs).

(3) Although it has been illustrated in the above-described embodiment that the interlock switch 74 interlocking with the front cover 15 is provided in the high voltage generating power supply 60, the present invention is not limited thereto. For example, the interlock switch 74 not in interlock with the front cover 15 may be provided in the high voltage generating power supply 60 or the interlock switch 74 may not be provided in the high voltage generating power supply 60.

(4) Although it has been illustrated in the above-described embodiment that the first and third boosting/rectifying units 65A and 65C are employed as the first high voltage generating unit and the second boosting/rectifying units 65B is employed as the second high voltage generating unit, the present invention is not limited thereto. For example, the third boosting/rectifying unit 65C may be omitted. In addition, since the printer 10 uses a high voltage such as a developing voltage, a cleaning voltage or the like, a boosting/rectifying unit which generates the high voltage such as the developing voltage, a cleaning voltage or the like may be employed as the first or second high voltage generating unit.

What is claimed is:

1. An image forming apparatus comprising:

an image forming unit which includes a photoconductor and forms an image on a recording medium;

an irradiating unit which irradiates the photoconductor with laser light;

a first low voltage power supply which generates a first low voltage;

a first low voltage power supply line which is connected to the irradiating unit and the first low voltage power supply and supplies the first low voltage from the first low voltage power supply to the irradiating unit;

a first switching element which has a control terminal electrically connected to the first low voltage power supply line and generates a first oscillating current;

a first high voltage generating unit which is connected to the first switching element and an electrical load of the image forming unit, wherein the first high voltage generating unit supplies a first high voltage to the electrical load of the image forming unit;

a first transformer which is included in the first high voltage generating unit and generates the first high voltage by boosting a second low voltage higher than the first low voltage based on the first oscillating current;

a second low voltage power supply which is connected to the first transformer and supplies the second low voltage to the first transformer;

a control unit which includes an input/output port electrically connected to the first low voltage power supply line and controls the first switching element;

a cover which can be opened and closed, wherein the image forming unit detects the opening and closing of the cover; and an interlock switch which interlocks with the opening/closing of the cover and includes a first contact point connected to the first low voltage power supply and a second contact point connected to the first low voltage power supply line, wherein the interlock switch is opened to disconnect the first contact point from the second contact point when the cover is opened.

2. The image forming apparatus according to claim 1, wherein the image forming unit includes a transferring unit which transfers an image formed on the photoconductor onto the recording medium by irradiating the laser light by the irradiating unit, and wherein the electrical load of the image forming unit to which the first high voltage is supplied is the transferring unit.

3. The image forming apparatus according to claim 1, further comprising:

a second switching element which has a control terminal electrically connected to the second low voltage power supply and generates a second oscillating current;

a second high voltage generating unit which supplies a second high voltage higher than the first high voltage to the electrical load of the image forming unit and includes a second transformer which generates the second high voltage by boosting the second low voltage based on the second oscillating current; and a low voltage power supply cutting-off unit which is electrically connected to the second contact point of the interlock switch and the second low voltage power supply and electrically disconnects the second low voltage power supply from the control terminal of the second switching element when the cover is opened.

4. The image forming apparatus according to claim 3, wherein the image forming unit includes a charger which charges the photoconductor, and wherein the electrical load of the image forming unit to which the second high voltage is supplied is the charger.

5. The image forming apparatus according to claim 3, wherein the first transformer includes an auxiliary winding electrically connected to the control terminal of the first switching element and the first low voltage power supply line at a primary side of the first transformer, the image forming apparatus further comprising:

a counter electromotive force cutting-off unit which is connected between the first low voltage power supply line and the auxiliary winding, switches ON/OFF supply of power from the first low voltage power supply line to the control terminal of the first switching element, and electrically disconnects the auxiliary winding from the first low voltage power supply line when the interlock switch is opened.

6. The image forming apparatus according to claim 5, further comprising:

a voltage application preventing unit which is connected between the low voltage power supply cutting-off unit and the counter electromotive force cutting-off unit and prevents the second low voltage from being applied to the counter electromotive force cutting-off unit.

7. The image forming apparatus according to claim 3, further comprising:

a pull-up resistor which is provided between the first low voltage power supply line and the input/output port of the control unit and pulls up the first low voltage, wherein, in the condition where the interlock switch is closed, the control unit makes the input/output port impedance-high when the first transformer and/or the second transformer is driving while making the input/output port logically low when the first transformer and the second transformer is stopping.

8. A high voltage generating power supply comprising:

a first low voltage terminal which receives a first low voltage from a first low voltage power supply;

a first low voltage power supply line which is connected to the first low voltage terminal;

a second low voltage terminal which receives a second low voltage higher than the first low voltage from a second low voltage power supply;

a second low voltage power supply line which is connected to the second low voltage terminal;

a first switching element which has a control terminal electrically connected to the first low voltage power supply line and generates a first oscillating current;

a first high voltage generating unit which generates a first high voltage and includes a first transformer which generates the first high voltage by boosting the second low voltage based on the first oscillating current;

a second switching element which has a control terminal electrically connected to the second low voltage power supply line and generates a second oscillating current;

a second high voltage generating unit which generates a second high voltage higher than the first high voltage and includes a second transformer which generates the second high voltage by boosting the second low voltage based on the second oscillating current;

a control unit which includes an input/output port electrically connected to the first low voltage power supply line and controls the first switching element and the second switching element; and a low voltage power supply cutting-off unit which is electrically connected to the input/output port and the second low voltage power supply line and electrically disconnects the second low voltage power supply line from the control terminal of the second switching element when supply of the first low voltage is cut off.

9. The high voltage generating power supply according to claim 8, wherein the first transformer includes an auxiliary winding electrically connected to the control terminal of the first switching element and the first low voltage power supply line at a primary side of the first transformer, the high voltage generating power supply further comprising:

a counter electromotive force cutting-off unit which is connected between the first low voltage power supply line and the auxiliary winding, switches ON/OFF supply of power from the first low voltage power supply line to the control terminal of the first switching element, and electrically disconnects the auxiliary winding from the first low voltage power supply line when the supply of the first low voltage is cut off.

10. The high voltage generating power supply according to claim 9, further comprising:

a voltage application preventing unit which is connected between the low voltage power supply cutting-off unit and the counter electromotive force cutting-off unit and prevents the second low voltage from being applied to the counter electromotive force cutting-off unit.

11. The high voltage generating power supply according to claim 8, further comprising:

a pull-up resistor which is provided between the first low voltage power supply line and the input/output port of the control unit and pulls up the first low voltage, wherein the control unit makes the input/output port impedance-high when the first transformer and the second transformer is driving while making the input/output port logically low when the first transformer and the second transformer is stopping.

* * * * *